United States Patent [19]

Huff et al.

[11] Patent Number: 4,998,774

[45] Date of Patent: Mar. 12, 1991

[54] STOOL SEAT

[75] Inventors: George L. Huff, Greeneville; Robert Archer, Johnson City; James P. Haynes, Chuckey, all of Tenn.

[73] Assignee: Meco Corporation, Greenville, Tenn.

[21] Appl. No.: 407,636

[22] Filed: Sep. 15, 1989

[51] Int. Cl.[5] ..... A47C 9/00

[52] U.S. Cl. ..... 297/461; 297/458; 297/DIG. 8

[58] Field of Search ..... 297/461, 452, 453, 458, 297/459, DIG. 2, DIG. 8

[56] References Cited

U.S. PATENT DOCUMENTS

| | | | |
|---|---|---|---|
| D. 273,926 | 5/1984 | Byrns . | |
| 587,224 | 7/1897 | McKelvey | 297/458 X |
| 2,825,393 | 3/1958 | Warburton et al. | 297/458 |
| 2,866,497 | 12/1958 | Struthers | 297/46 X |
| 3,029,109 | 4/1962 | Nail | 297/461 |
| 3,125,377 | 3/1964 | Bridges | 297/DIG. 8 X |
| 3,370,885 | 2/1968 | Gale | 297/452 X |
| 3,770,319 | 11/1973 | Ono | 297/461 |
| 4,295,680 | 10/1981 | Grasso . | |
| 4,555,140 | 11/1985 | Nemoto | 297/DIG. 8 X |
| 4,592,589 | 6/1986 | Hellwig | 297/458 X |
| 4,615,464 | 10/1986 | Byrns . | |

FOREIGN PATENT DOCUMENTS

| | | | |
|---|---|---|---|
| 742101 | 11/1943 | Fed. Rep. of Germany | 297/453 |
| 2084458 | 4/1982 | United Kingdom | 297/DIG. 2 |

*Primary Examiner*—José V. Chen

*Attorney, Agent, or Firm*—Luedeka, Hodges & Neely

[57] ABSTRACT

A stool seat includes an impermeable top wall having an upper surface upon which a user sits and a peripheral edge. The top wall is sealingly joined along its peripheral edge to an impermeable bottom wall and is adapted to support itself in spaced relation above the bottom wall so that the top wall is suspended above the bottom wall from its peripheral edge to provide a single sealed cavity containing a fluid at a predetermined pressure between the top and bottom walls. The top wall is further adapted to resiliently deflect toward the bottom wall under the weight of the user so that the pressure of the fluid in the sealed cavity is increased when the user sits upon the upper surface.

9 Claims, 2 Drawing Sheets

STOOL SEAT

This invention relates generally to a seat for stools and relates more particularly to a stool seat which utilizes an air cushion to enhance the cushioning effect of the seat beneath the weight of a user.

Stool seats which utilize a cushion of air to soften the seat are known. One such seat, shown and described in U.S. Pat. No. 3,770,319, includes a deformable hollow seating compartment having walls comprised of a polymeric sheet material and wherein the interior of the seating compartment communicates with the ambient air through one or more restricted passages. When the seating compartment deforms beneath the weight of a user, air escapes from the compartment interior at a controlled rate through the restricted passages.

It is an object of the present invention to provide a new and improved stool seat which utilizes a cushion of air to enhance the cushioning effect of the seat beneath the weight of a user.

Another object of the present invention is to provide such a seat which is relatively comfortable when used.

Still another object of the present invention is to provide such a seat which is relatively economical to construct and effective in operation.

Yet another object of the present invention is to provide a stool which includes a new and improved stool seat.

In general, the invention resides in a seat for a stool comprising means defining an impermeable top wall having an upper surface upon which a user sits and a peripheral edge, and means defining an impermeable bottom wall sealingly joined to the top wall along the peripheral edge. The top wall is adapted to support itself above the bottom wall so that the top wall is suspended above the bottom wall from its peripheral edge to provide a sealed cavity containing a fluid at a predetermined pressure between the top and bottom walls. The top wall is further adapted to resiliently deflect toward the bottom wall under the weight of the user so that the pressure of the fluid in the sealed cavity is increased when the user sits upon the upper surface.

These and other features will be described in greater detail hereinafter with reference to the accompanying drawings in which.

Figure 2:
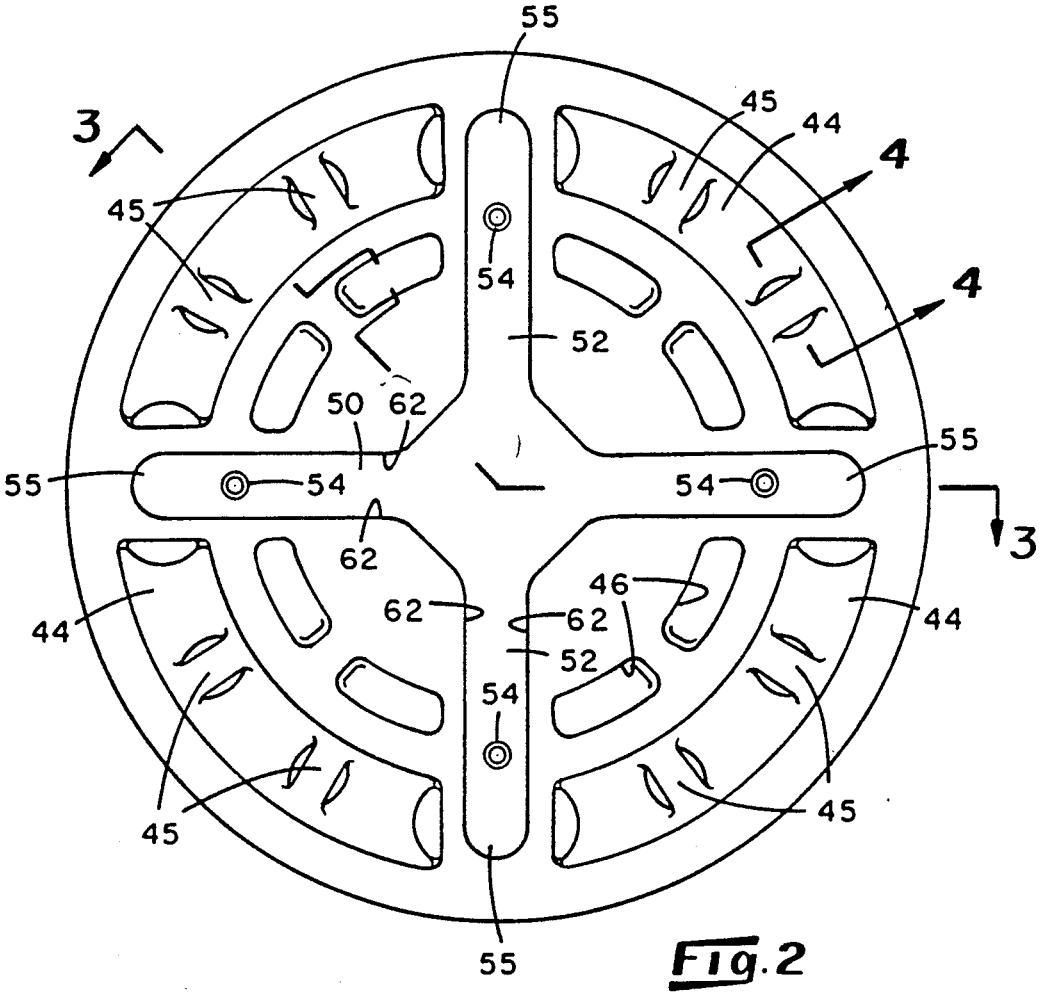
FIG. 2 is a bottom plan view of the FIG. 1 seat embodiment shown removed from the remainder of the stool.
Figure 3:
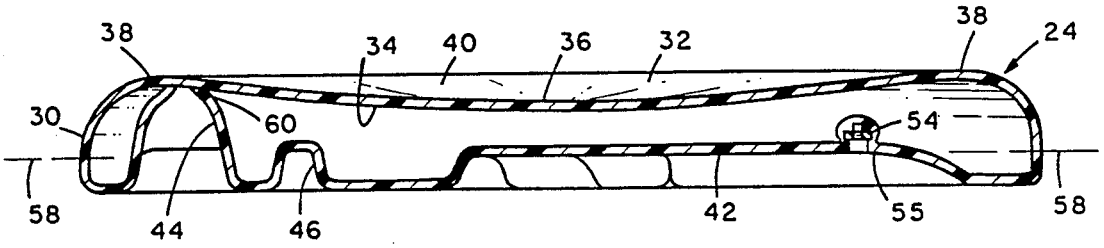

FIG. 3 cross-sectional view taken along line 3—3 of FIG. 2; and

Figure 4:
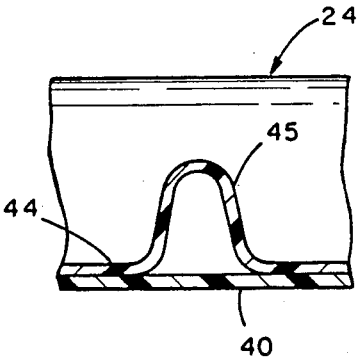

FIG. 4 is a cross-sectional view of taken along line 4—4 of FIG. 2.

Figure 1:
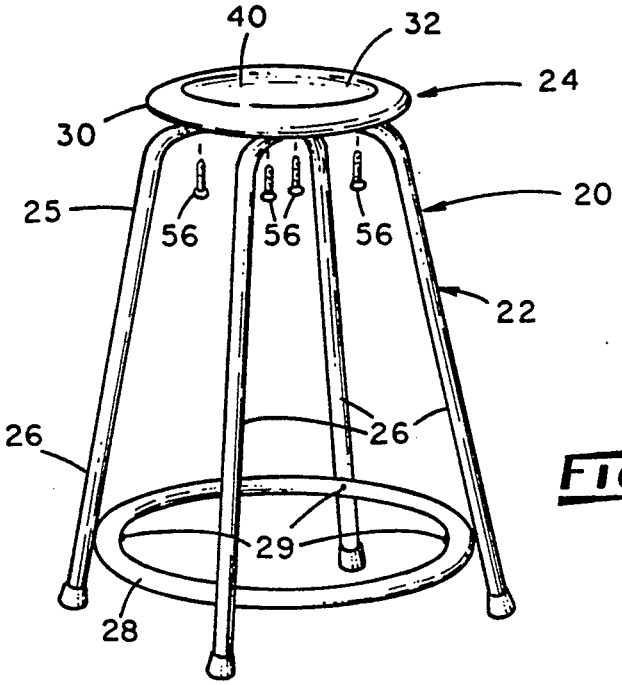
FIG. 1 is a perspective view of a stool, shown exploded, within which an embodiment of a seat is incorporated.

With initial reference to FIG. 1, there is shown a stool 20 including a frame 22 and a seat 24. The frame 22 includes tubular members 25 joined together in an appropriate manner so as to provide four legs 26 having upper ends which form a cruciform arrangement and having lower ends which are joined together by means of a tubular ring member 28 and screws 29. The cruciform arrangement formed by the tubular members 25 defines a substantially horizontal plane upon which the seat 24 rests, and the seat 24 is attached to the tubular members 25 of the cruciform arrangement to thereby secure the seat 24 to the frame 22.

Referring now to FIGS. 1 and 3, the seat 24 is comprised of a hollow shell 30 formed of an impermeable plastic material. The shell 30 defines an upper surface 32 adapted to resiliently deflect under the weight of a user and a single fluid-filled interior cavity 34 underlying substantially the entire upper surface 32. The interior cavity 34 is sealed from the atmosphere and the fluid contained therein is preferably air at about atmospheric pressure. Because the cavity 34 is sealed, no air is permitted to escape from the cavity 34 when the user sits upon the upper surface 32 so that the pressure of the trapped air increases to provide an air cushion beneath the user. It will be understood that although the depicted seat 24 is shown and described as being filled with air, a seat may include another fluid, such as gas contained within the pockets of a foam material. Accordingly, the principles of the present invention can be variously applied.

The shell 30 is formed, preferably by a blow-molding process, so as to provide a substantially circular self-supporting top wall 40 sealingly joined to a substantially circular bottom wall 42 along the sides of the shell 30, and so that the sealed interior cavity 34 is defined between the top and bottom walls 40, 42. Each of the top and bottom walls 40 and 42 is relatively thin and is preferably constructed as a unitary body out of a high density polyethylene. The top wall 40 defines the upper surface 32 and is shaped so as to provide the upper surface 32 with a concave central portion 36, as best shown in FIG. 3, and a rounded marginal portion 38 encircling the central portion 36. Because the top wall 40 is joined to the bottom wall 42 only along the sides of the shell 30 and is a self-supporting construction, the top wall 40 is suspended by its peripheral edge across the entire width, or span, of the interior cavity 34.

As shown in FIGS. 2 and 3, the bottom wall 42 defines a series of concentrically-arranged sets of stiffening ribs 44, 46 which resist deformation or deflection of the bottom wall 42 beneath the weight of a user. Each rib 44 of the radially-outermost set of ribs 44 is shaped so as to project generally upwardly toward the top wall 40 and so that its uppermost portion 60 is touching (i.e., fused) to the underside of the top wall 42 and directly beneath the rounded marginal portion 38 of the top wall 42. With the uppermost portions 60 positioned beneath the top wall 42 as aforedescribed, the ribs 44 limit or prohibit the downward deflection of the marginal portion 38 of the upper surface 32 beneath the weight of the user. That is, once the central portion 36 of the upper surface 32 deflects downwardly toward the bottom wall 42 by a predetermined amount, the engagement between the marginal portion 38 and the ribs 44 restricts additional downward deflection of the top wall 40 at the marginal portion 38.

In the illustrated seat embodiment 24, the sets of ribs 44, 46 enhance the resistance to deflection or deformation of the bottom wall 42 in a vertical direction. To this end, there are eight ribs 46 which are regularly spaced about the center of the bottom wall 42, and there are four ribs 44 which are regularly spaced about the center of the bottom wall 42. Moreover, and with reference to FIGS. 1 and 4, each rib 44 includes a pair of transversely-extending internal ribs 45. It is believed that the arrangement and shape of the ribs 44, 46, as shown and described, are responsible for the desirable resistance to deflection of the bottom wall 42 beneath the weight of a user.

The bottom wall 42 also includes a pair of linear recesses 50, 52 which intersect at about the center of the bottom wall 42, as viewed in FIG. 2, and which are shaped to accept the cruciform arrangement of tubular members 25 formed at the upper ends of the legs 26. In this connection, portions of the recesses 50, 52 define downwardly-facing surfaces 55 oriented in a plane 58 for engageably overlying the tubular members 25 of the cruciform arrangement, and each of the recesses 50, 52 includes sidewalls 62 which are positioned on opposite sides thereof so as to which capture the tubular members 25 of the cruciform arrangement therebetween when the tubular members 25 are placed into the recesses 50, 52.

In addition, four square nuts 54 are embedded and retained within the bottom wall 42 for providing downwardly-opening internally-threaded apertures therein. When the seat 24 is operatively positioned upon the frame 22, the internally-threaded apertures provided by the nuts 54 are aligned with through-openings defined in the tubular members 25 of the cruciform arrangement. In order to secure the seat 24 to the frame 22, threaded screws 56 (FIG. 1) or similar shanked fasteners are inserted through the openings of the cruciform arrangement and tightened within the nuts 54 so that the frame 22 is tightly held between the heads of the screws 56 and the nuts 54.

When producing the seat 24 by a blow molding process, one or more air pin holes are formed at convenient locations along the bottom wall 42 to enable the cavity 34 to communicate with the surrounding atmosphere so that the internal pressure of the cavity 34 after molding is equal to that of the atmosphere. The air pin holes are subsequently sealed by means of a heat stake or plug so that air is trapped within the cavity 34 preferably at about atmospheric pressure.

When a user initially sits upon the seat 24, the concave central portion 36 of the upper surface 32 deflects, or deforms, downwardly toward the bottom wall 42 and the rounded marginal portion 38 of the upper surface 32 may deflect radially inwardly to accommodate the downward displacement of the concave central portion 36. The concave shape of the upper surface 32 is advantageous in that it accepts the user's buttocks in a manner rendering the seat comfortable to sit upon and distributes the weight of the user relatively uniformly across the upper surface 32. Furthermore, because the air trapped within the interior cavity 34 is not permitted to escape during the deflection of the upper surface 32, the trapped air is compressed to an elevated level beneath the weight of the user and is believed to augment the resiliency of the top wall 40 while providing a permanent cushion of air beneath the user which does not decrease over time. Also, at the preferred atmospheric pressure level of the air originally sealed within the seat, the internal pressure of the seat cavity 34 is believed to increase to a level which provides the seat 24 with a desirable level of comfort not capable of being achieved when the air initially sealed within the seat 24 is at pressures significantly higher than atmospheric, e.g. 5.0 psig or above. Therefore, the preferred pressure level of the seat cavity 32 is advantageous in this respect. In addition, the internal pressure distribution across the curved underside of the top wall 40 is believed to be responsible for a deflection in the top wall which enhances the user's comfort when the seat 24 is sat upon. By comparison, this top wall 40 providing a concave central portion 36 is believed to render the seat more comfortable than seats having top walls of other configurations.

For purposes of illustration, preferred dimensions of the seat 24 are provided here as follows:

The overall width of the seat 24 is about 12.0 inches (30.5 cm), the maximum height of the seat 24 as measured through the rounded marginal portions 38 of the upper surface 32 is about 1.44 inches (3.66 cm), the radius of curvature of the concave central portion of the upper surface 32 is about 36.0 inches (91.4 cm), the thickness of the bottom wall 42 is preferably constant and equal to about 0.055 to about 0.080 inches (0.14 to 0.20 cm), the thickness of the top wall is a minimum of 0.10 inches (0.25 cm) and may be up to 0.15 inches (0.38 cm).

It will be understood that numerous modifications and substitutions can be had to the aforedescribed embodiment without departing from the spirit of the invention.

For example, although the aforedescribed seat 24 has been shown and described above as including top and bottom walls 40, 42 which engage one another along the tops of the strengthening ribs 44, a seat in accordance with the broader aspects of the invention may include a top wall which is spaced from the strengthening ribs of the bottom wall when the top wall is in an undeflected condition. In such an embodiment, the spaced relation between the top and bottom walls permits the top wall to be deflected downwardly toward the bottom wall by a predetermined amount before the ribs of the bottom wall engage the top wall in a manner restricting additional downward deflection of the top wall. Accordingly, the aforedescribed embodiment is intended for the purpose of illustration and not as limitation.

What is claimed is:

1. A stool seat comprising:

means providing an impervious top wall defining an upper surface upon which a user sits and having a peripheral edge, said upper surface being shaped so as to provide a concave seating area for the user;

means providing an impervious bottom wall sealingly joined to the top wall along said peripheral edge, said top wall adapted to support itself in a suspended condition above said bottom wall from said peripheral edge to provide a single sealed cavity containing a fluid at a predetermined pressure between said top and bottom walls and said top wall being further adapted to resiliently deflect toward said bottom wall under the weight of a user so that the pressure of the fluid contained in the sealed cavity is increased when the user sits upon said upper surface, said upper surface adapted to deflect downwardly under the weight of a user and said bottom wall includes a series of ribs encircling the center of said bottom wall for rigidifying said bottom wall and arranged to extend along paths forming a pair of concentrically-arranged rows of ribs, the ribs of at least one of said rows projecting generally upwardly toward the top wall so as to restrict downward deflection of the upper surface beyond a predetermined limit.

2. The seat as defined in claim 1 wherein the upper surface of said top wall includes a central area which provides the concave seating area for the user and includes a rounded marginal portion extending about the central portion.

3. The seat as defined in claim 1 wherein said fluid contained in said cavity is air and the pressure of the air in said interior cavity is about equal to atmospheric pressure when the upper surface is in an undeflected condition.

4. The seat as defined in claim 3 the pressure of the air in said interior cavity is less than 5.0 psig when the top wall is an undeflected condition.

5. The seat as defined in claim 1 wherein said upper surface includes a marginal portion adjacent said peripheral edge and said upwardly-projecting ribs of said bottom wall is disposed generally beneath said marginal portion and extends for a substantial distance along said peripheral edge.

6. The seat as defined in claim 1 wherein said top and bottom walls are constructed as a unitary body out of a high-density plastic material.

7. A stool seat comprising a hollow relatively hard plastic shell having sides and including top and bottom walls which are joined along the sides of said shell to provide a single interior cavity extending across said shell between said sides and between said top and bottom walls so that said top wall is suspended from the shell sides over said bottom wall and across the interior cavity, said top wall including a central portion which is concave when said central portion is viewed externally of the shell and being adapted to resiliently deflect downwardly toward said bottom wall under the wight of a user, said interior cavity being sealed so as to trap air therein and the internal pressure of said interior cavity being about equal to atmospheric pressure when said top wall is in an undeflected condition, said upper surface adapted to deflect downwardly under the weight of a user and said bottom wall includes a series of ribs encircling the center of said bottom wall for rigidifying said bottom wall and arranged to extend along paths forming a pair of concentrically-arranged rows of ribs, the ribs of at least one of said rows projecting generally upwardly toward the top wall so as to restrict downward deflection of the upper surface beyond a predetermined limit.

8. A stool comprising:

frame means providing legs for the stool; and a seat positioned upon so as to overlie the frame means, said seat including a hollow shell having a top wall defining an upper surface adapted to resiliently deflect under the weight of a user and defining a single interior cavity underlying substantially the entire upper surface, said upper surface having a central concave seating area and said interior cavity being sealed so as to trap an amount of fluid therein at a predetermined pressure and so that when the upper surface deflects under the weight of a user, the pressure of the fluid trapped in said cavity is increased, said upper surface adapted to deflect downwardly under the weight of a user and said bottom wall includes a series of ribs encircling the center of said bottom wall for rigidifying said bottom wall and arranged to extend along paths forming a pair of concentrically-arranged rows of ribs, the ribs of at least one of said rows projecting generally upwardly toward the top wall so as to restrict downward deflection of the upper surface beyond a predetermined limit.

9. The stool as defined in claim 8 wherein the predetermined pressure of the fluid is within the range of about atmospheric and 5.0 psig when the upper surface of the top wall is in an unreflected condition.

* * * * *